US006131005A

United States Patent [19]

Ozawa

[11] Patent Number: 6,131,005

[45] **Date of Patent: *Oct. 10, 2000**

[54] STRUCTURE MEMBER AND IMAGE FORMING APPARATUS USING SUCH STRUCTURE MEMBER

[75] Inventor: Takashi Ozawa, Numazu, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/150,286

[22] Filed: Sep. 9, 1998

[30] Foreign Application Priority Data

Sep. 11, 1997 [JP] Japan ..... 9-247089

[51] Int. Cl.[7] ..... G03G 15/00

[52] U.S. Cl. ..... 399/107; 52/789.1; 52/793.1; 108/57.26

[58] Field of Search ..... 399/107; 52/789.1, 52/793.1, 798.1; 108/57.26, 901

[56] References Cited

U.S. PATENT DOCUMENTS

| | | | |
|---|---|---|---|
| 3,172,509 | 3/1965 | Dugger | 52/798.1 X |
| 3,658,687 | 4/1972 | Egnaczak et al. | 399/107 |
| 4,247,839 | 1/1981 | Takizawa | 399/107 |
| 5,390,467 | 2/1995 | Shuert | 52/789.1 X |
| 5,612,117 | 3/1997 | Belanger et al. | 52/793.1 X |
| 5,635,306 | 6/1997 | Minamida et al. | 52/793.1 X |

*Primary Examiner*—Sophia S. Chen
*Attorney, Agent, or Firm*—Fitzpatrick, Cella, Harper & Scinto

[57] ABSTRACT

A structure member includes a first plate member formed from a thin metal plate and having a plurality of frusto-pyramid projections arranged in a staggered fashion, and a second plate member formed from a thin metal plate and having a plurality of frusto-pyramid projections having dimensions different from those of the projections of the first plate member and arranged in a staggered fashion. The first and second plate members are overlapped in such a manner that tip ends of the frusto-pyramid projections of the plate members are opposed to each other but are not overlapped with each other, and overlapped and contacted portions are joined together to form a single plate body.

11 Claims, 8 Drawing Sheets

$$d1 = (5 \text{ TO } 20) \times t$$

$$d1 \geqq \frac{d2}{3}$$

$$\theta = 45^\circ \text{ TO } 60^\circ$$

$$p \simeq d1 + d2 + 4t$$

STRUCTURE MEMBER AND IMAGE FORMING APPARATUS USING SUCH STRUCTURE MEMBER

BACKGROUND OF THE INVENTION

1. Field of the Invention

The present invention relates to a structure member made of thin metal and an image forming apparatus using such a structure member.

2. Related Background Art

Recently, in copying machines and multi-function printers which are medium-sized office equipment, a sheet supply tray and an automatic both-face device have been incorporated into a body of the equipment and installation space for the equipment and an outer dimension of the equipment have been reduced. In addition, in order to improve operability for users or service men, there has been adopted an arrangement in which less parts are arranged in a front surface of the equipment from which various elements disposed within the equipment can be drawn forwardly so that replenishment of toner and maintenance can be performed at the front surface of the equipment.

In an electrophotographic copying machine shown in FIG. 8, a convey unit portion 7 supporting an image forming portion, regist rollers, a convey portion and a fixing device, sheet supply portions 2, 3, 4 and 5 and a both-face unit portion 6 can be drawn forwardly, and a structure member for supporting such unit portions is shown as a hatched portion 8, and a bottom plate 9 constituting a bottom structure has a small thickness (10 to 30 mm).

In this way, installation space, configuration and arrangement for the structure members such as side plates, bottom plate and stay have been limited more and more. Particularly, although the bottom plate which is the bottom structure is the most important structure member (among all structure members of the apparatus) in view of the fact that it supports the weight of the apparatus, it has been requested that a thickness of the bottom plate is reduced as much as possible to reduce the height of the apparatus and to make the apparatus more compact.

Since the bottom plate is the structure member which must have great rigidity for supporting the weight of the apparatus and holding other front and rear structure members, if the rigidity of the bottom plate is insufficient, various disadvantages will occur. For example, if a floor on which the apparatus is rested is distorted, the bottom plate will be deformed due to the distortion to deform the entire apparatus, so that positional relation between various elements disposed within the apparatus is deviated to result in erroneous operation (particularly, in a copying machine, a precise positional relation between elements contributing to image formation is deviated to result in distortion of an obtained image).

Further, when the apparatus is moved, casters attached to the bottom plate are subjected to great load. In such a case, if the rigidity of the bottom plate to which the casters are attached is insufficient, portions of the bottom plate to which the casters are attached are deformed, thereby causing poor image and/or abnormal operation of the casters.

In order to avoid the above disadvantages, as shown in FIG. 9, drawing areas have been provided on the bottom plate 9 to reinforce the bottom plate or a reinforcement member such as a cross-member has been integrally attached to the bottom plate thereby to increase the rigidity of the bottom plate. However, since these attempts are effected regarding limited areas of the bottom plate, the reinforcing effect is partial and inadequate, the rigidity of the entire bottom plate cannot be improved.

Incidentally, FIG. 9 is a perspective view showing main structure members constituting a medium-sized copying machine and, in FIG. 9, the reference numeral 10 denotes a front side plate; 11 denotes a rear side plate; 12, 13 denote right side stay members; and 14, 15 denote left side stay members. These elements are formed from steel plates having a thickness of about 1 to 3 mm. The front side plate 10 and the rear side plate 11 are joined to the bottom plate 9 and the stay members 12, 13, 14 and 15 are joined to the front side plate 10 and the rear side plate 11 by screws or welding, thereby providing an integral structure member of the copying machine.

Further, since the added reinforcement member cannot improve the rigidity efficiently, effective mating with increase of cost cannot be obtained.

On the other hand, recently, a problem regarding operation noise of the apparatus has been watched and reduction of noise of the apparatus has been requested. However, sources of noise within the apparatus has been increased and, thus, an important technical problem is to prevent the noise from leaking from the apparatus. To solve this problem, it is requested that the rigidity of the structure members of the apparatus is increased to prevent vibration of the structure members caused by the noise sources.

In order to solve this problem, in the past, a member for preventing the vibration (vibration isolating and noise shielding material such as glass wool) has been added. However, such material is very expensive, thereby increasing the cost of the entire apparatus.

However, it is difficult to ensure the adequate rigidity of the structure members as the compactness of the apparatus and improvement in incorporated function (for example, increase of the number of contained sheets) have been requested more and more.

SUMMARY OF THE INVENTION

An object of the present invention is to provide a structure member capable of solving the above-mentioned problems and an image forming apparatus having such a structure member.

Another object of the present invention is to provide a general-purpose thin structure member having excellent rigidity and formed from fewer parts and an image forming apparatus having such a structure member.

A further object of the present invention is to provide a structure member of an office equipment in which deformation of the office equipment due to its own weight and due to distortion of a floor can be suppressed by providing great rigidity of a bottom portion within a limited space (thickness of about 10 to 30 mm) of the office equipment and noise of the office equipment can be reduced by providing excellent noise shielding ability and an image forming apparatus having such a structure member.

To achieve the above objects, according to the present invention, there is provided a structure member comprising a first plate member formed from a thin metal plate and having a plurality of frusto-conical projections disposed in a staggered fashion, and a second plate member formed from a thin metal plate and having a plurality of frusto-conical projections having dimensions different from those of the projections of the first plate member and disposed in a staggered fashion. Wherein, the frusto-conical projections of these two plate members are overlapped in the same direction and overlapped and contacted portions are fastened together to form a single plate body.

Further, to achieve the above objects, the present invention provides an image forming apparatus having image forming parts attached to the above-mentioned structure member.

DETAILED DESCRIPTION OF THE PREFERRED EMBODIMENTS

The present invention will now be explained in connection with embodiments thereof with reference to the accompanying drawings.

Figure 1:
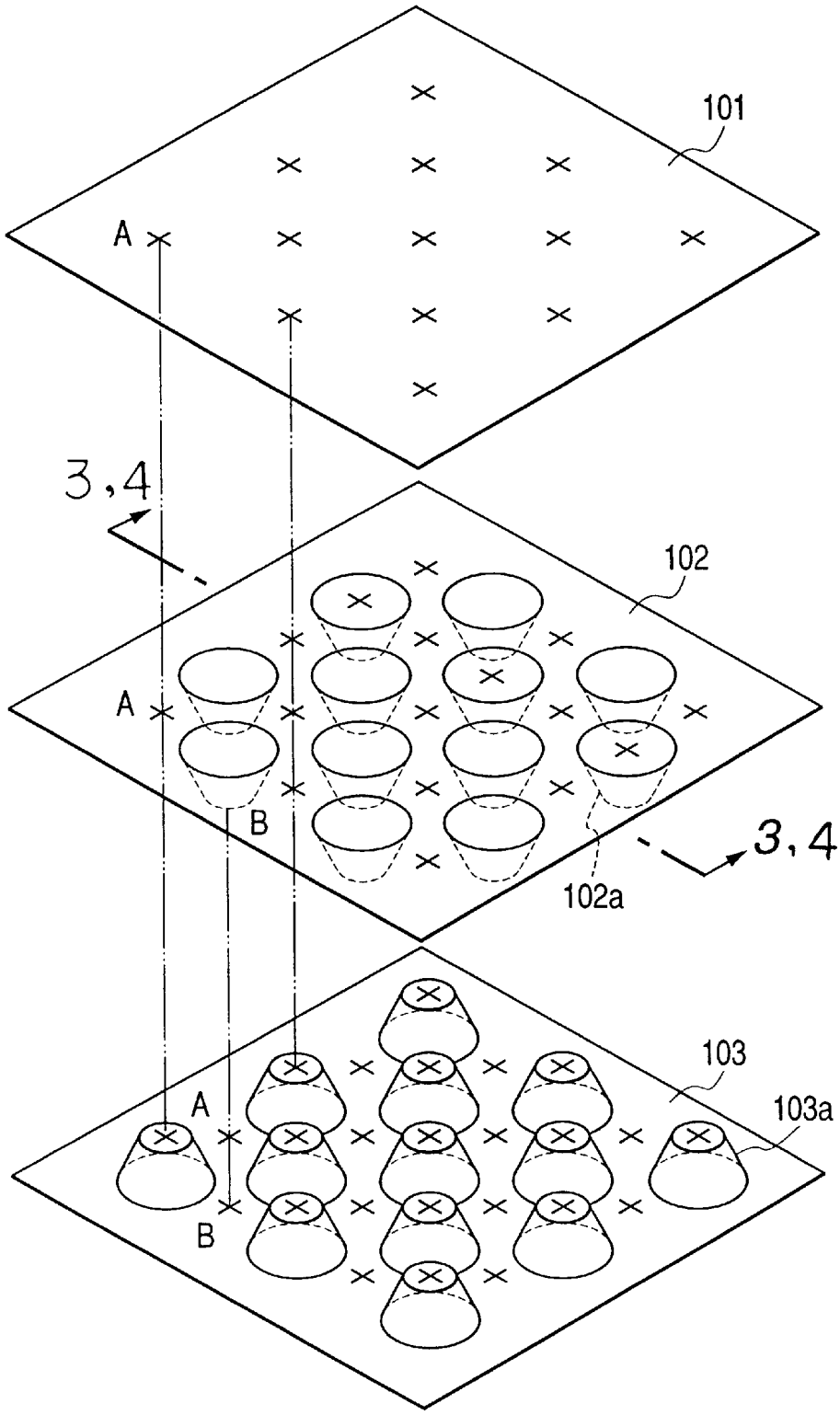
FIG. 1 is an exploded perspective view showing a fundamental construction (constructural elements) of a structure member according to the present invention.

FIG. 1 is an exploded perspective view showing a fundamental construction (constructural elements) of a structure member according to the present invention.

In FIG. 1, an outer flat plate 101 is formed from a steel plate member made of steel or stainless steel, and intermediate plates 102, 103 are formed from steel plate members on which a plurality of frusto-conical projections 102*a*, 103*a* are arranged in a staggered fashion. Incidentally, the frusto-conical projections 102*a*, 103*a* of the intermediate plates 102, 103 are formed by a press drawing technique.

Figure 2:
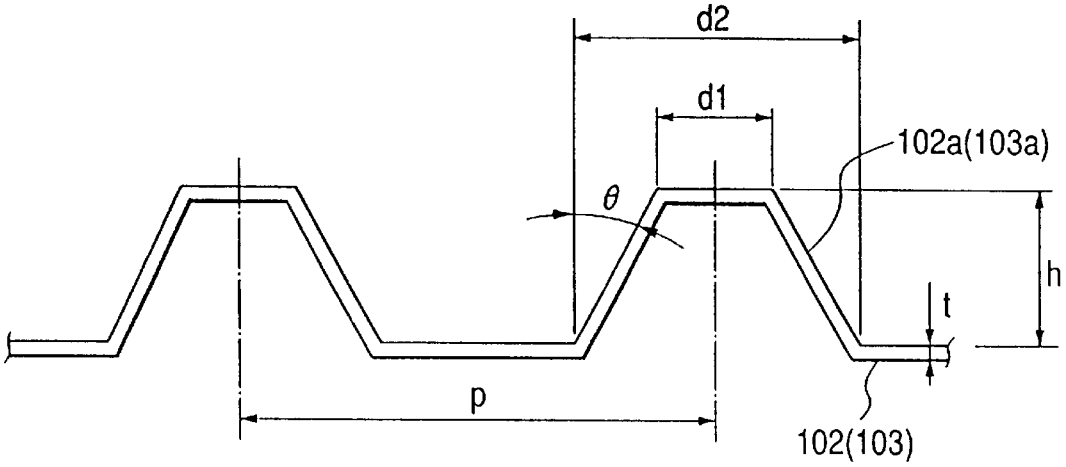
FIG. 2 is a partial sectional view showing a construction of an intermediate plate of the structure member according to the present invention.

Now, the configuration of the frusto-conical projections 102*a*, 103*a* of the intermediate plates 102, 103 will be explained with reference to FIG. 2. A diameter d1 of a top circular surface of each of the projections 102*a*, 103*a* is selected to be greater than a thickness t of a base plate of each intermediate plate 102, 103 by 5 to 20 times (5 t to 20 t) in consideration of stability of the drawing technique and assurance of an adequate fastening force at the top surface and to be ⅓ of a diameter d2 of a bottom of the projection or more.

Further, an angle θ of an inclined surface of each frusto-conical projection 102*a*, 103*a* is selected to be 45° to 60° in consideration of stability of the drawing technique and increase in rigidity. In addition, a pitch p between the projections is selected to (d1+d2)+4 t in consideration of stability of the drawing technique and increase in rigidity.

On the basis of the above-mentioned manufacturing conditions and a space available in the apparatus, various dimensions are determined and, in the illustrated embodiment, the outer plate 101 and the intermediate plates 102, 103 are formed from rolled steel plates and the various dimensions are determined as follows:

| | |
|---|---|
| thickness of base paltes of intermediate plate and outer plate | t = 1.6 mm |
| diameter of top surface of projection | d1 = 16 mm |
| diameter of base of projection | d2 = 32 mm |
| inclined angle of frusto-conical projection | θ ≃ 60° |
| height of intermeidate plate | h = 13.2 mm |

Figure 3:
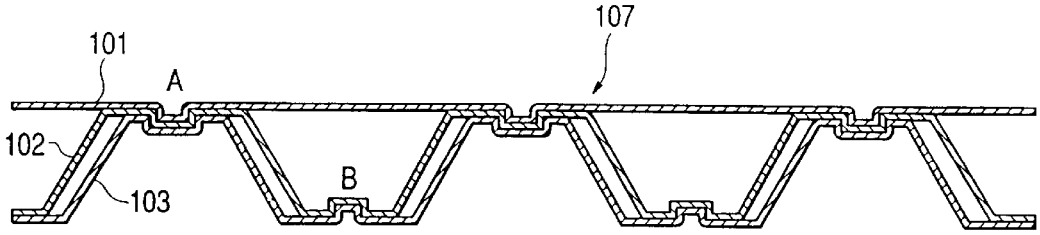
FIG. 3 is a partial sectional view of the structure member according to the present invention taken along the line 3—3 in FIG. 1.
Figure 4:
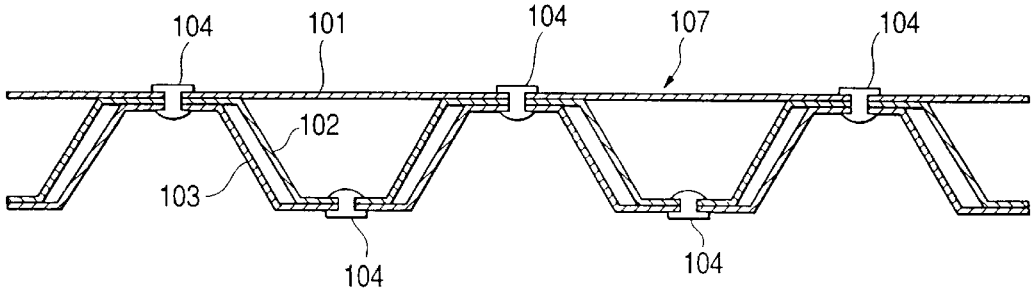
FIG. 4 is a partial sectional view of the structure member according to the present invention taken along the line 4—4 in FIG. 1.
Figure 10:
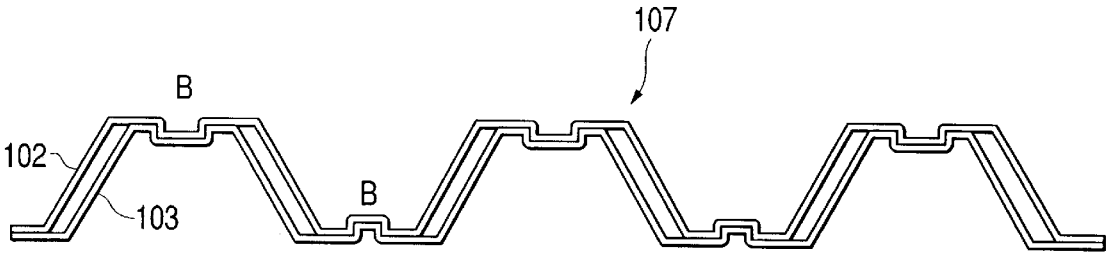
FIG. 10 is a partial sectional view showing a sectional configuration of a structure member according to another embodiment of the present invention.

FIGS. 3, 4 and 10 show a configuration of a structure member 107 after joining.

As shown in FIGS. 3, 4 and 10, the outer plate 101 and the intermediate plates 102, 103 are overlapped in such a manner that the projections 102*a* and the projections 103*a* are faced with each other (one facing upwardly and the other facing downwardly) and are deviated from each other in a direction parallel with planes of the plates, and the plates are joined to each other at top surfaces shown by "+" in FIG. 1. That is to say, at points A, the outer plate 101 and the intermediate plates 102, 103 are joined to each other, and at points B, only two intermediate plates 102, 103 are joined to each other and, thus, fundamentally the plates are joined to each other at all of the top surfaces.

FIG. 3 is a sectional view showing a structure member 107 obtained by joining and deforming the outer plate 101 and the intermediate plates 102, 103 themselves by caulking in a press, and FIG. 4 is a sectional view showing a structure member 107 obtained by joining the outer plate 101 and the intermediate plates 102, 103 by using rivets 104 as fastening members. As another fastening method, electric welding may be used.

Figure 5:
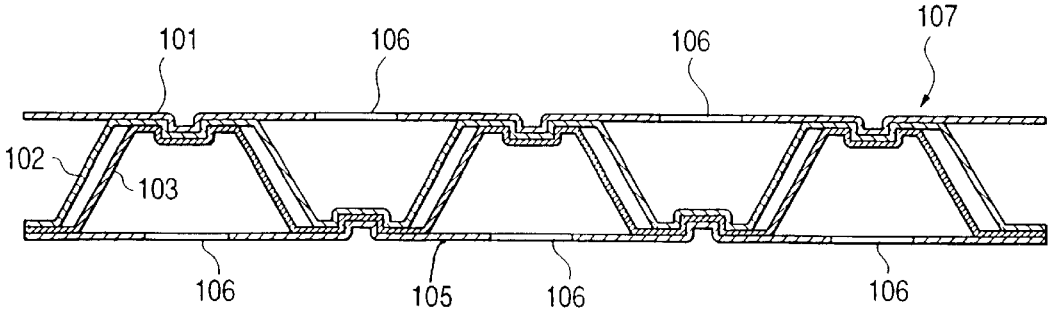
FIG. 5 is a partial sectional view showing another construction of a structure member according to the present invention.

FIG. 5 shows another sectional configuration of a structure member 107. In the structure member 107 having the sectional configuration shown in FIG. 5, the outer plates 101, 105 are fastened to both sides of intermediate plates 102, 103. By providing the outer plates 101, 105 on both sides of the intermediate plates 102, 103 in this way, in comparison with the structure members shown in FIGS. 3 and 4, rigidity can be further increased. Incidentally, in this construction, since the press is introduced when the caulking of the outer plates 101, 105 is effected, openings 106 are formed in the outer plates.

FIG. 10 shows a sectional configuration of a structure member 107 according to another embodiment of the present invention. The structure member 107 having the sectional configuration shown in FIG. 10 is constituted only by intermediate plates 102, 103, which are, at points B, joined to each other by caulking. By omitting the outer plate(s), the number of parts is decreased, thereby making the structure cheaper.

By the way, when welding is used other than the above-mentioned joining methods, although the effect of the invention is unchanged in the caulking fastening method shown in FIG. 3, the manufacturing cost can be reduced in comparison with other joining methods, to the extent of the manufacturing cost of the conventional bottom plate, since the caulking fastening process can be incorporated into a series of press working for forming the outer plates 101, projections 102*a*, 103*a* of the intermediate plates 102, 103 and the outer surfaces.

Figure 6:
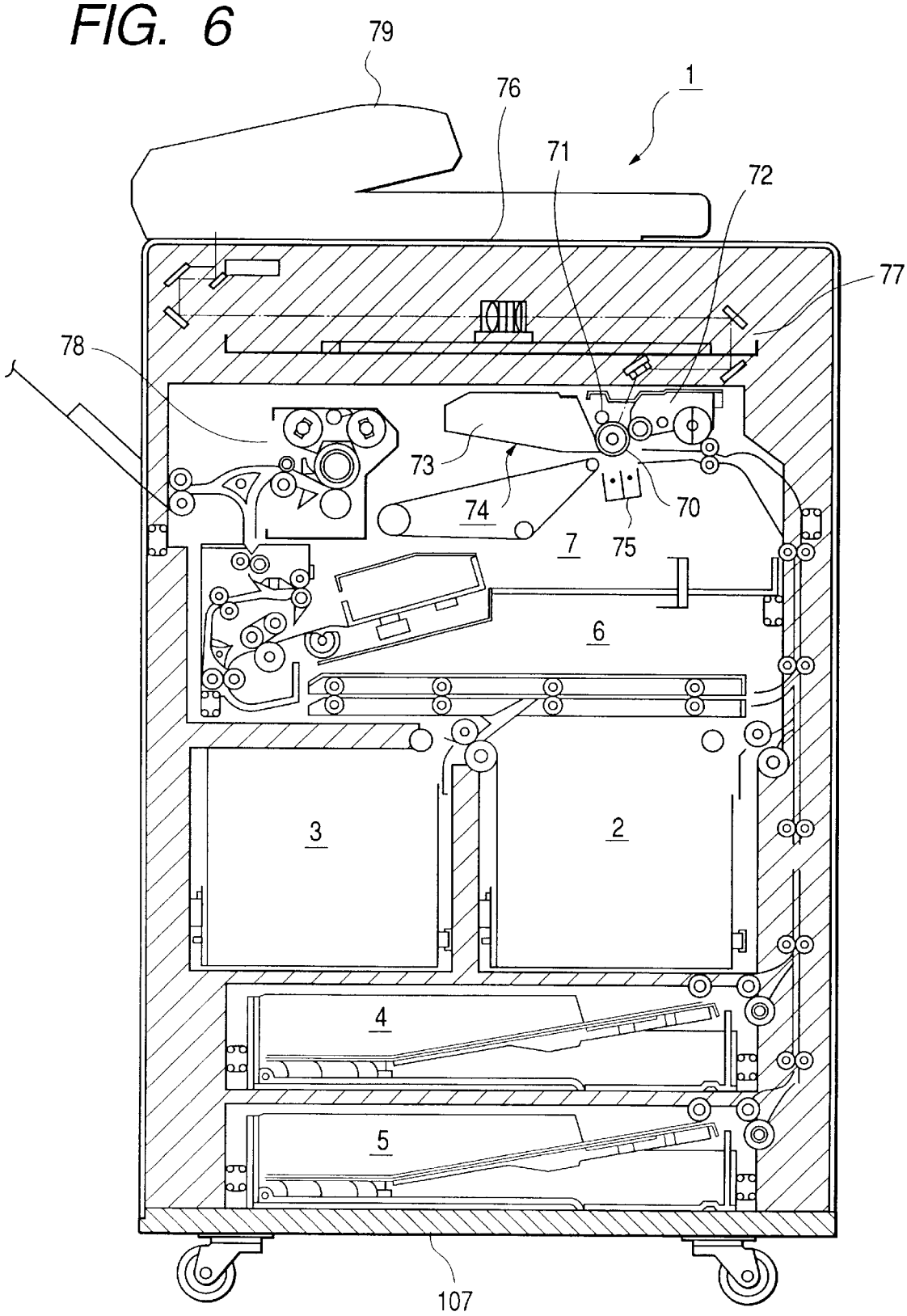
FIG. 6 is a sectional view of a copying machine having the structure member according to the present invention.

FIG. 6 is a sectional view of a copying machine in which the structure member 107 according to the present invention is used as a bottom plate (shown cross-hatched portion) 107.

Next, performance of the structure member 107 according to the present invention will be explained.

Figure 7:
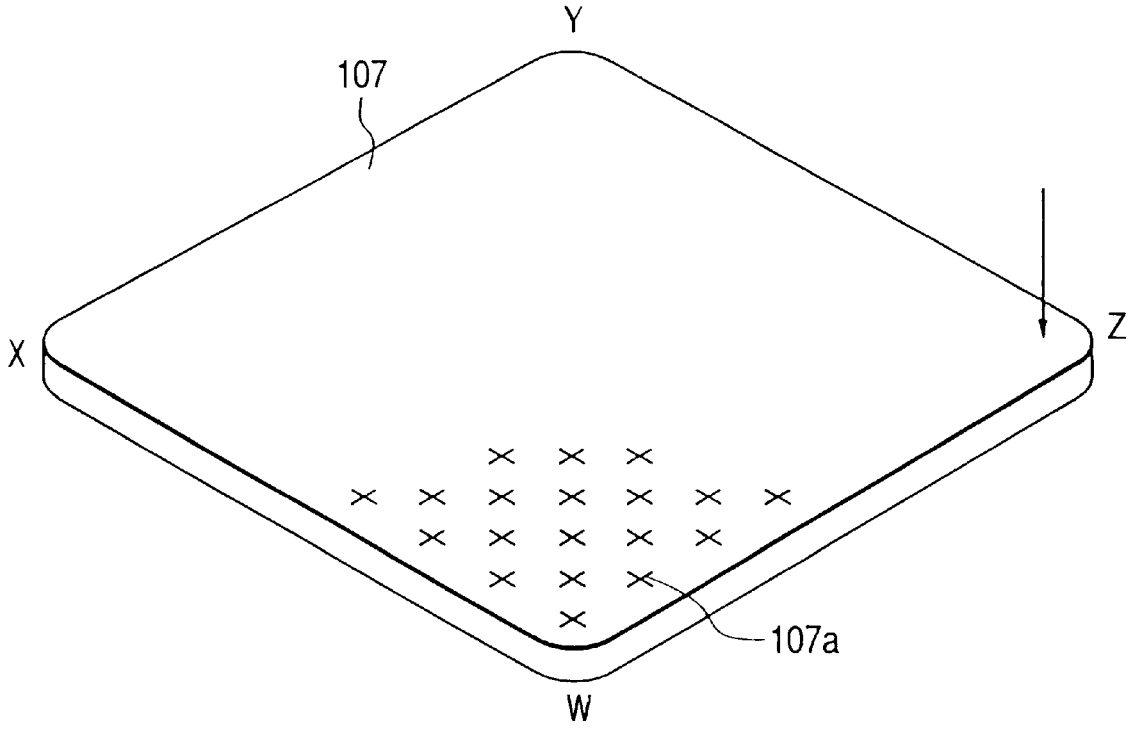
FIG. 7 is a perspective view of a structure member according to the present invention.
Figure 8:
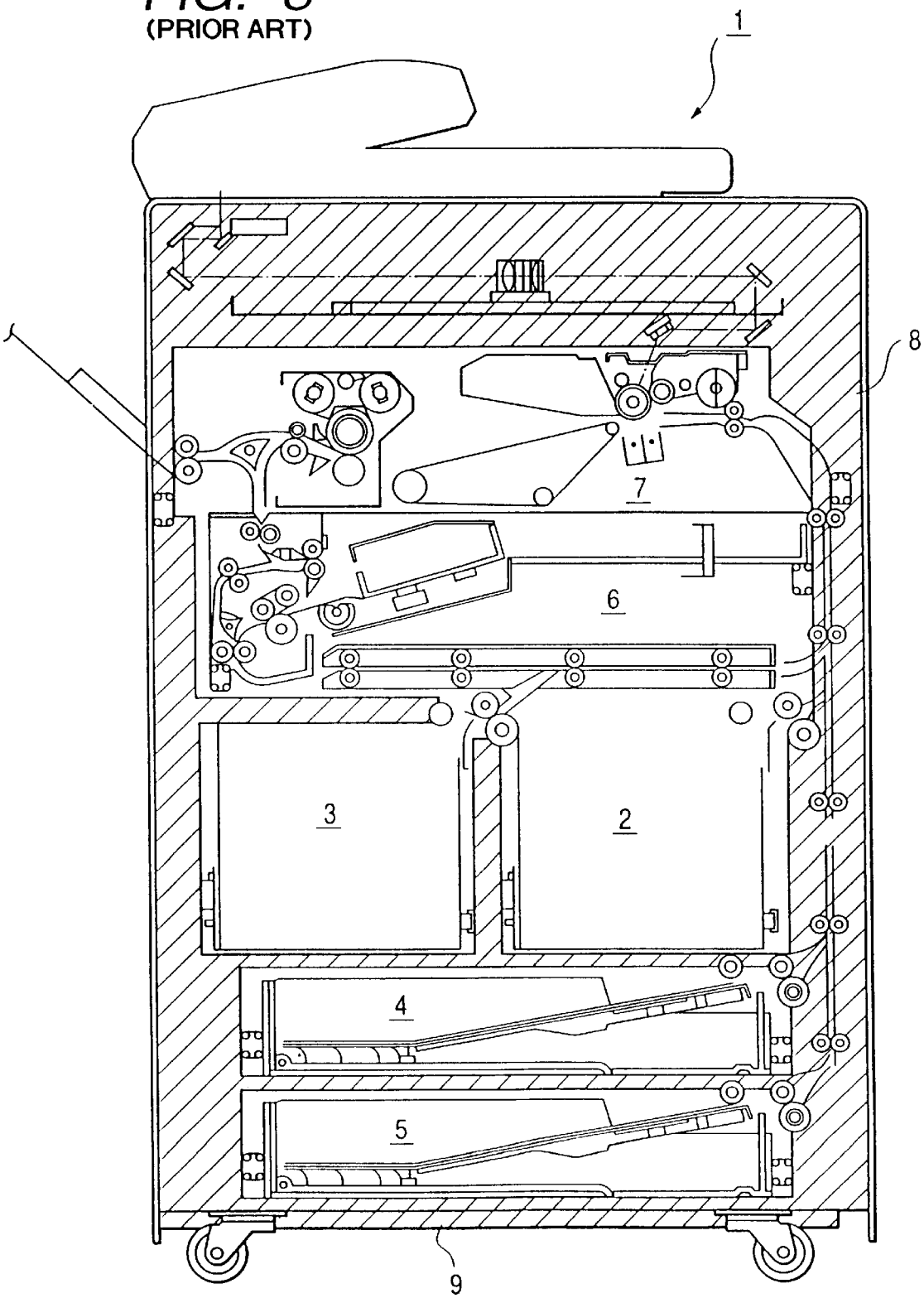
FIG. 8 (PRIOR ART)
FIG. 8 is a sectional view of a copying machine having a conventional structure member.

Three corners W, X and Y (among four corners W, X, Y and Z) of a structure member 107 (having a dimension of about 700 mm×700 mm) as shown in FIG. 7 are supported, and a load directing toward a direction shown by the arrow is applied to free corner Z. In this case, simulation calculation results of deformed amounts of the corner Z are shown in the following Table 1. Incidentally, in FIG. 7, the reference numeral 107*a* ("+") shows positions where the caulking fastening were effected.

TABLE 1

Comparison in deformed amounts (comparison in rigidity)

| Configuration of structure member | Thickness of structure member | | |
|---|---|---|---|
| | 10 mm | 12 mm | 14 mm |
| Raw material (Steel plate not worked) | 100 | 60 | 39 |
| Outer one side type (FIG. 4) | 156 | 108 | 78 |
| Outer both sides type (FIG. 5) | 116 | 85 | 62 |

The Table 1 shows results obtained by calculating the deformed amounts regarding the raw material (having the greatest rigidity in the same material) and two types of the structure members 107 (one having the outer plate at one side and the other having the outer plates at both sides) having thicknesses of 10 mm, 12 mm and 14 mm, respectively. As the material, steel plates which have frequently been used as a structure member of an office equipment were selected, and steel plates having a thickness of 1.6 mm were used as the outer plate(s) and the intermediate plates. Regarding the results, the deformed amount of the raw material having a thickness of 10 mm is indicated as "100", and the smaller the numerical value the smaller the deformed amount (i.e., the greater the rigidity).

Further, the following Table 2 shows comparison in weight of the structure members compared in the above Table 1. Incidentally, similar to the Table 1, in the Table 2, the weight of the raw material having a thickness of 10 mm is indicated as "100", and the smaller the numerical value the lighter the structure member.

TABLE 2

| Configuration of structure member | Thickness of structure member | | |
|---|---|---|---|
| | 10 mm | 12 mm | 14 mm |
| Raw material | 100 | 120 | 140 |
| Outer one side type | 48 | 48 | 48 |
| Outer both side type | 64 | 64 | 64 |

From the results of the Tables 1 and 2, in the structure members 107 according to the present invention, it was found that rigidity equivalent to the rigidity of the raw material having the thickness of 12 mm can be obtained by the structure member of outer both side type having the thickness of 14 mm and, in this case, the weight of the structure member is about a half of the raw material. Further, the actual deformed amount of the structure member of outer both side type having the thickness of 14 mm was about 0.7 mm when the load of 10 kg was applied to the corner D in FIG. 7, and the weight of the structure member 107 was about 15 kg. These numerical values means that satisfactorily high rigidity can be obtained when this structure member 107 is used as the bottom plate of the office equipment and adequate rigidity can be ensured even when the total weight exceeds 200 kg due to combination of the structure member (bottom plate) and other side structure members.

The following Table 3 shows simulation calculation results of deformed amounts of various types of structure members 107 when substantially the same number of steel plates (having a thickness of 1.6 mm) usually used as structure members were used, as is in the Table 1.

TABLE 3

| Type of structure member | Number of steel plates | Deformed amount (mm) | ratio (%) |
|---|---|---|---|
| Laminated member (Raw material) | 4 | 1.12 | 100 |
| No outer plate (FIG. 10) | 2 | 0.44 | 39 |
| One side outer plate (FIG. 3) | 3 | 0.32 | 29 |
| Both side outer plate (FIG. 5) | 4 | 0.23 | 21 |

From the result shown in the Table 3, it is apparent that, in comparison with the laminated member of raw material, the structure members 107 according to the present invention reduce the deformed amounts greatly (increase the rigidity). Particularly, in the structure member having no outer plate and using only two steel plates, the deformed amount is greatly reduced. Further, it is also apparent that the deformed amount is reduced (i.e., rigidity is increased) in accordance with the number of the outer plates.

The following Table 4 shows simulation calculation results indicating a relation between the deformed amount and the number of projections of the structure member having the configuration shown in FIG. 3.

TABLE 4

| | Pattern 1 | Pattern 2 |
|---|---|---|
| d2 | 45 | 60 |
| θ | 45 | 45 |
| N | 121 | 55 |
| p | 100 | 140 |
| DA | 0.601 | 0.639 |

where, d2 is a diameter of the bottom of the projection; θ is an angle of the inclined surface of the frusto-conical projection; N is the number of projections; p is a pitch between the projections; and DA is a deformed amount.

It was proved that the greater the number of projections the smaller the deformed amount (i.e., the greater the rigidity). Further, from the above results, it can be understood that a method for arranging a plurality of projections (which are one of features of the present invention) efficiently is effective to increase the rigidity of the structure member.

In the illustrated embodiment, two intermediate plates 102, 103 are overlapped so that they are not opposed to each other and at least one outer plate 101 is overlapped with the intermediate plates, and the intermediate plates 102, 103 and the outer plate 101 are integrally joined together at the top surfaces of the projections 102*a*, 103*a*, thereby forming the structure member 107 for the office equipment. Thus, a honeycomb-like structure is formed in the structure member 107 to increase the rigidity thereof, with the result that the great rigidity of the bottom plate can be ensured within the limited space (thickness of about 10 to 30 mm) of the copying machine 1. As a result, deformation of the copying machine 1 due to its own weight and due to the distortion of the floor can be suppressed. Since the structure member 107 can be manufactured by the normal press working and any reinforcement member is not required to be attached to the structure member by welding unlike the conventional techniques, the manufacturing cost of the structure member 107 can be reduced.

Further, since the structure member 107 for the copying machine 1 is formed by joining the intermediate plates 102, 103 and the outer plate 101 at the plurality of points, high noise shielding ability of the structure member 107 is ensured, with the result that propagation of the noise generated within the copying machine 1 can be prevented by the structure member 107 effectively, thereby reducing the noise of the copying machine 1. Since the structure member 107 itself has the high noise shielding ability in this way, it is not required to add any noise shielding member, with the result that the number of parts is reduced, thereby making the copying machine 1 lighter and cheaper.

As mentioned above, according to the illustrated embodiment, only a plurality of intermediate plates formed from thin metal plates and having frusto-conical projections arranged in a staggered fashion, or these intermediate plates and a flat outer plate are used, and the plurality of intermediate plates are overlapped in such a manner that the projections are not opposed to each other in opposite directions and the intermediate plates (and the outer plate, if provided) are integrally joined to each other to form the structure member. Thus, for example, the deformation of the copying machine 1 due to its own weight and due to the distortion of the floor can be suppressed by ensuring the great rigidity of the bottom plate within the limited space (thickness of about 10 to 30 mm) of the office equipment, and the noise of the office equipment can be reduced by ensuring the high noise shielding ability of the structure member.

Figure 11:
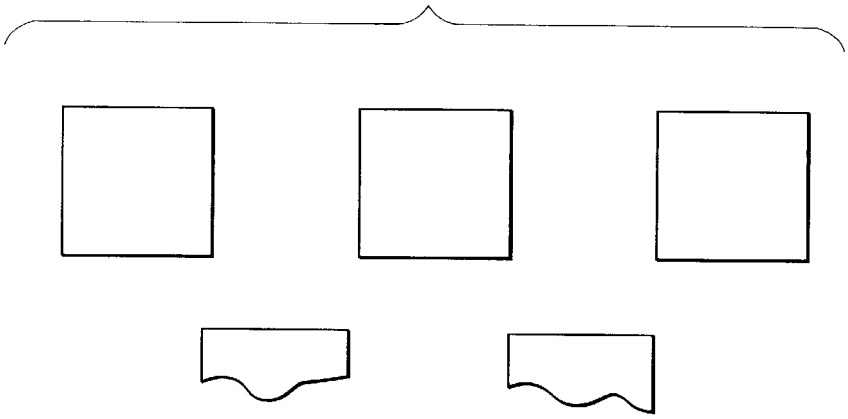
FIG. 11 is an explanatory view showing an alteration of a frusto-conical pattern of the structure member according to the present invention.
Figure 12:
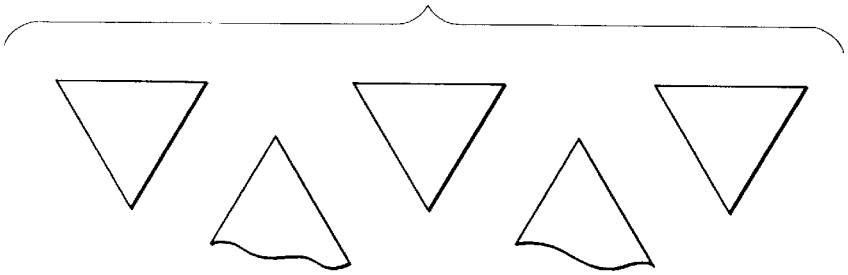
FIG. 12 is an explanatory view showing another alteration of a frusto-conical pattern of the structure member according to the present invention.

Now, alterations of the structure members will be described. The configuration of each projection is not limited to the above-mentioned frusto-conical shape, but a frusto-conical shape having a square cross-section as shown in FIG. 11 or a trigonal pyramid as shown in FIG. 12 or other polygonal pyramids may be used.

The feature of the structure member according to the present invention is that it comprises a first plate member formed from a thin metal plate and having a plurality of frusto-conical projections arranged in a staggered fashion, and a second plate member formed from a thin metal plate and having a plurality of frusto-conical projections having dimensions different from those of the projections of the first plate member and arranged in a staggered fashion. Wherein, the frusto-conical projections of these two plate members are overlapped in the same direction and overlapped and contacted portions are joined together to form a single plate body.

With this arrangement, the thickness of the structure member can be reduced as much as possible and, at the same time, adequate strength can be obtained.

Now, an electrophotographic apparatus as an example of an image forming apparatus having the above-mentioned structure member will be described with reference to FIG. 6.

An image forming portion has a process unit 74 including an electrophotographic photosensitive member 70, and a charge roller 71, a developing device 72 and a cleaning device 73 which are disposed around the photosensitive member. Below the photosensitive member 70, there is disposed a transfer and separation charger 75.

In image formation effected by the image forming portion, the photosensitive member 70 is charged by the charge roller 71, and an image of an original rested on an original support 76, beneath over 79, is exposed onto the photosensitive member through an optical system 77 disposed at an upper part of the apparatus, thereby forming a latent image. The latent image is developed by the developing device 72 as a toner image. The toner image formed on the photosensitive member is transferred onto a transfer sheet being conveyed, and then the transfer sheet is sent to a fixing device 78, where the toner image is thermally fixed to the transfer sheet. Thereafter, the transfer sheet is discharged out of the apparatus. On the other hand, after the transferring, residual toner remaining on the photosensitive member is removed by the cleaning device 73, thereby preparing for next image formation. Incidentally, an automatic original feeding device is disposed above the above-mentioned electrophotographic apparatus.

The image forming apparatus to which the structure member according to the present invention can be applied is not limited to the above-mentioned copying machine, but the structure member can be applied to an electrophotographic printer and an electrophotographic facsimile in which an image is not directly formed from an original image. Further, other than the electrophotographic apparatus, the structure member can be applied to compact image forming apparatuses such as an ink jet printer.

As is in the above-mentioned embodiment, when the structure member according to the present invention is applied to the image forming apparatus, since the vibration within the apparatus can be suppressed by the structure member having fewer parts, image quality can be improved. Further, since the structure member provides spaces therewithin, noise generated within the apparatus can be reduced.

Figure 9:
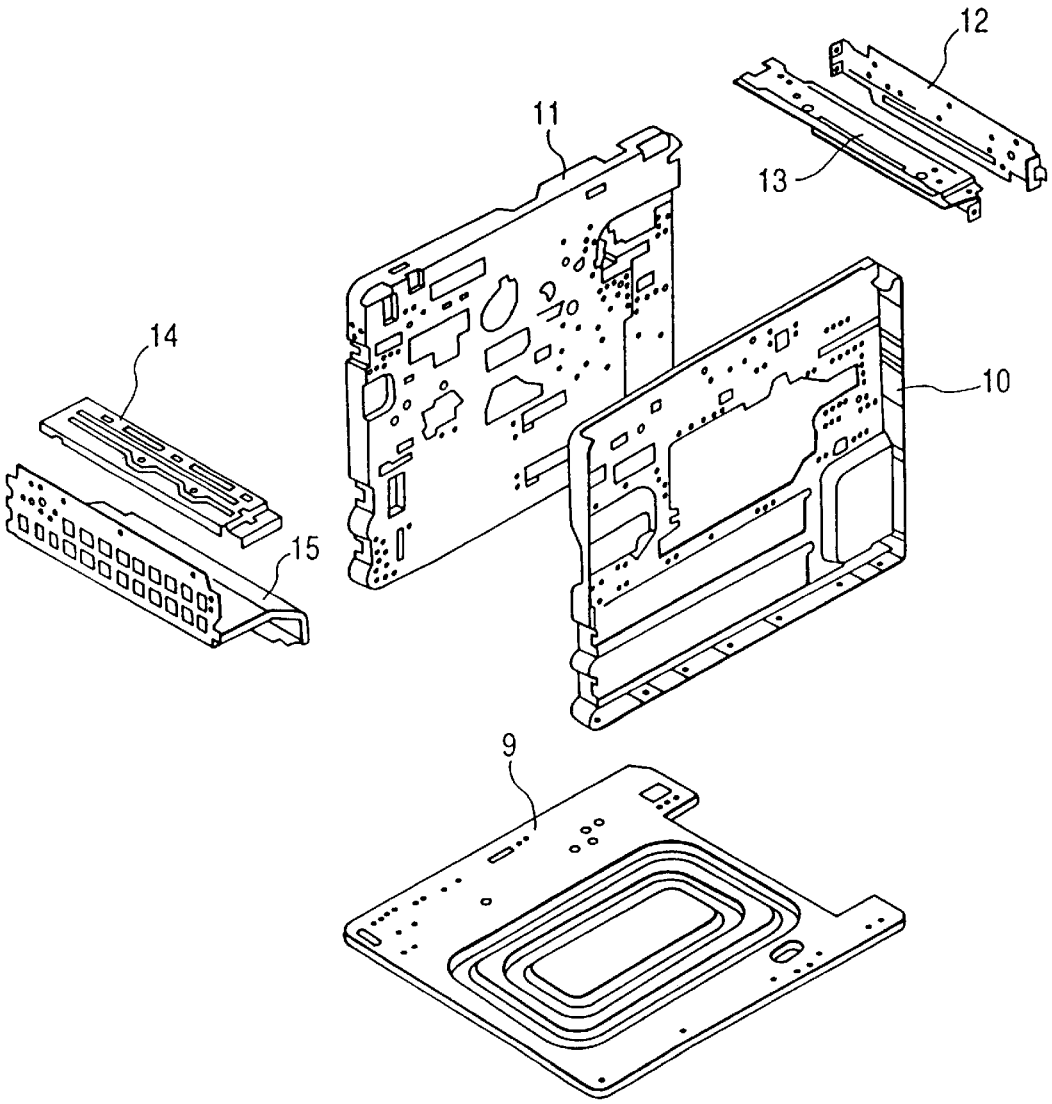
FIG. 9 (PRIOR ART)
FIG. 9 is an exploded perspective view of the conventional structure member.

Incidentally, while an example that the structure member of the present invention is applied to the bottom plate of the image forming apparatus was explained, such structure member may also be applied to the front and rear side plates 10, 11 and/or the stay portions 12, 14 as shown in FIG. 9.

What is claimed is:

1. A structure member comprising:

a first plate member formed by press working of a thin metal plate and having a plurality of truncated cone-shaped projections; and a second plate member formed by press working of a thin metal plate and having a plurality of truncated cone-shaped projections, wherein said first and second plate members are stacked in such a manner that a surface of said first plate member on which said plurality of truncated cone-shaped projections are provided is opposite to a surface of said second plate member on which said plurality of truncated cone-shaped projections are provided and that tip ends of said plurality of truncated cone-shaped projections of said first and second plate members are not overlapped with each other so that said plurality of truncated cone-shaped projections of said first and second plate members are arranged in a staggered fashion, and wherein contacted portions of said first and second plate members are joined together to form a single plate body.

2. A structure member according to claim 1, wherein an additional single thin metal plate is stacked on and joined to a stack of said first and second plate members to form said single plate body.

3. A structure member according to claim 1, wherein the joining is effected by caulking.

4. A structure member according to claim 1, wherein the joining is effected by fastening using rivets.

5. A structure member according to claim 1, wherein the joining is effected by electrical welding.

6. An image forming apparatus comprising:

a frame portion of an apparatus body including a structure member formed by a single plate body, said structure member including: a first plate member formed by press working of a thin metal plate and having a plurality of truncated cone-shaped projections; and a second plate member formed by press working of a thin metal plate and having a plurality of truncated cone-shaped projections, wherein said first and second plate members are stacked in such a manner that a surface of said first plate member on which said plurality of truncated cone-shaped projections are provided is opposite to a surface of said second plate member on which said plurality of truncated cone-shaped projections are provided and that tip ends of said plurality of truncated cone-shaped projections of said first and second plate members are not overlapped with each other so that said plurality of truncated cone-shaped projections of said first and second plate members are arranged in a staggered fashion, and wherein contacted portions of said first and second plate members are joined together to form said single plate body; and an image forming element attached to said frame portion.

7. An image forming apparatus according to claim 6, wherein an additional single thin metal plate is stacked on and joined to a stack of said first and second plate members to form said single plate body.

8. An image forming apparatus according to claim 6, wherein said structure member is used as a bottom plate portion of said apparatus on which the greatest gravity force acts.

9. An image forming apparatus according to claim 6, wherein an entire housing of said apparatus is constituted by combining said structure member with metal plate member.

10. An image forming apparatus according to claim 9, wherein said image forming element includes an electrophotographic photosensitive member, and said apparatus body constitutes an electrophotographic image forming apparatus.

11. An image forming apparatus according to claim 10, wherein said apparatus body includes an optical system for exposing an original image onto said electrophotographic photosensitive member, and said apparatus body constitutes an electrophotographic copying machine.

* * * * *

UNITED STATES PATENT AND TRADEMARK OFFICE

CERTIFICATE OF CORRECTION

PATENT NO. : 6,131,005
DATED : October 10, 2000
INVENTOR(S) : Takashi Ozawa

It is certified that error appears in the above-identified patent and that said Letters Patent is hereby corrected as shown below:

Column 4,
Line 9, "(d1 + d2) +4 t" should read -- d1 + d2 + 4t --.

Column 8,
Line 34, "over" should read -- cover --.

Column 10,
Line 28, "metal" should read -- a metal --.

Signed and Sealed this

Second Day of October, 2001

*Attest:*

Nicholas P. Godici

*Attesting Officer*

NICHOLAS P. GODICI
*Acting Director of the United States Patent and Trademark Office*